US007070667B1

(12) United States Patent
Kirby

(10) Patent No.: US 7,070,667 B1
(45) Date of Patent: Jul. 4, 2006

(54) METHOD AND TOOL FOR INSTALLING TILE ON A WALL

(76) Inventor: Mark E Kirby, 2297 Jones Dr., Dunedin, FL (US) 34698

( * ) Notice: Subject to any disclaimer, the term of this patent is extended or adjusted under 35 U.S.C. 154(b) by 194 days.

(21) Appl. No.: 10/708,720

(22) Filed: Mar. 19, 2004

(51) Int. Cl.
*E04F 13/14* (2006.01)
*B23Q 3/18* (2006.01)
*E04G 21/22* (2006.01)

(52) U.S. Cl. ..... 156/71; 248/346.05; 248/346.06; 269/309; 269/311; 52/747.11

(58) Field of Classification Search ..... 248/346.01, 248/346.05, 346.06; 269/309, 311, 904; 156/71; 52/754.21, 747.1, 747.11, 749.11; 33/371, 376, 410, 411, 518, 526, 562, 648, 33/809, DIG. 20
See application file for complete search history.

(56) References Cited

U.S. PATENT DOCUMENTS 1,836,846 A * 12/1931 Hannay ..... 33/406
2,466,919 A * 4/1949 Sykes ..... 33/526
5,048,890 A * 9/1991 Masuda ..... 296/216.08
5,263,260 A * 11/1993 Smith ..... 33/526
5,761,876 A * 6/1998 Keady ..... 52/749.13

* cited by examiner

*Primary Examiner*—Chris Fiorilla
*Assistant Examiner*—Sing P. Chan
(74) *Attorney, Agent, or Firm*—Ronald E. Smith; Smith & Hopen, P.A.

(57) ABSTRACT

Tiles are installed on a vertical wall by employing an elongate, straight device that includes a spirit level. The device is positioned in overlying relation to the wall and rotated until it is horizontal as indicated by the spirit level. A plurality of longitudinally spaced and vertically staggered slots is formed in the device. Each slot receives a fastener so that the device can be secured to studs behind the wall. A row of tile supported by the device is then installed on the wall. The fasteners are removed after the tile installation is complete so that the device can be moved and re-used. Opposite ends of the device are configured to releasably engage a device of the same structure so that multiple devices can be linked together. An alternative embodiment is notched along its extent to provide utility in the context of convex and concave walls.

5 Claims, 8 Drawing Sheets

PRIOR ART

PRIOR ART

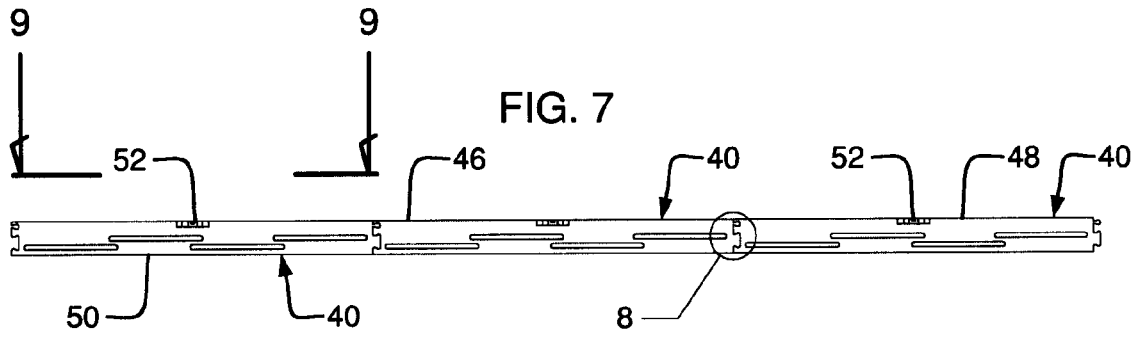
FIG. 7
FIG. 8
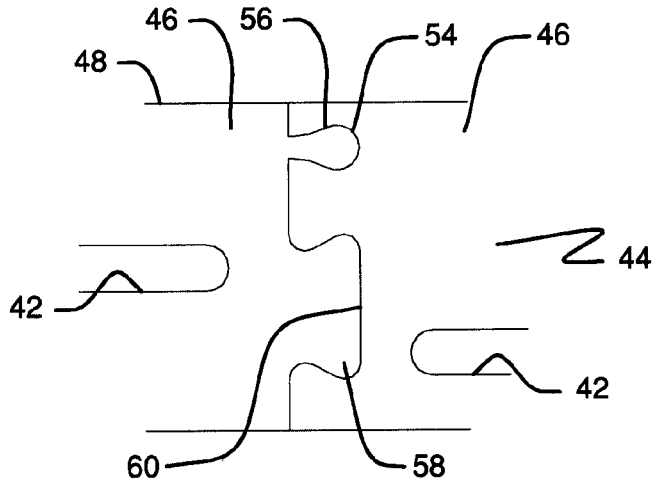
FIG. 9
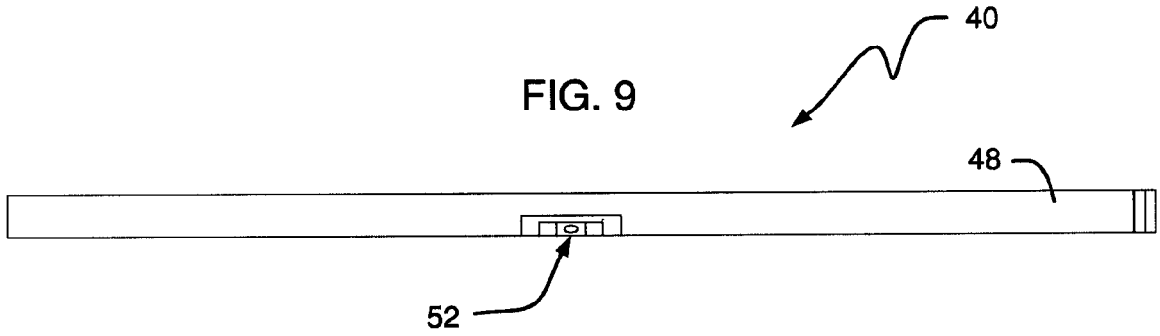

METHOD AND TOOL FOR INSTALLING TILE ON A WALL

BACKGROUND OF INVENTION

1. Field of the Invention

This invention relates, generally, to tile installation. More particularly, it relates to a device that facilitates the mounting of tile to a vertical support surface.

2. Description of the Prior Art

No major difficulties are encountered when installing small, light-in-weight tiles on a vertical support surface because the holding power of the cement, adhesive, or mastic upon which the tiles are mounted is sufficient to prevent the tiles from slipping.

However, installing large, relatively heavy tiles on a vertical support surface is problematic because the holding power of the adhesive means is insufficient to prevent slippage of the tiles under the force of gravity.

In the tile installation industry, a job that calls for the tiling of a wall with heavy tiles is begun by measuring a predetermined distance, such as a few inches, from the floor to the wall. This measurement is performed once. A laser level or a water level is then used to indicate a level line along the entire extent of a wall. This is the preferred method because it is well-known that floors may be warped. Thus, making a plurality of measurements from the floor to the wall could result in an uneven line on the wall.

A number of boards, known as furring strips, are then nailed to the wall such that the respective upper edges of the furring strips are coincident with the straight, horizontal line indicated by the water level or the laser level. However, furring strips are often warped, so shims must be used to insure that the furring strips follow the level line.

These furring strips support the tiles that are applied to the wall. The installer begins by placing a first, bottom row of tiles on the wall where they are supported against downward slippage by the furring strip. Additional rows of tiles are then be installed above the lowermost row until the job is completed. The furring strips are then removed.

There are a number of problems with this well-known tile installation method. Using a ruler to make the initial measurement, using a water level or a laser level to generate the level line, and securing the furring strips and shims as needed to the wall are obviously time-consuming steps.

Another disadvantage is inherent in the fact that furring strips cannot be reused very many times because they are full of nail holes after a few uses.

An improved method for installing heavy tiles on vertical surfaces is therefore needed, as is a tool for performing the steps of the method. The improved method would provide consistently straight, horizontal lines but would not rely upon furring strips.

However, in view of the prior art considered as a whole at the time the present invention was made, it was not obvious to those of ordinary skill in the pertinent art how an improved installation method could be provided.

SUMMARY OF INVENTION

The long-standing but heretofore unfulfilled need for an improved method of installing tile on a vertical support surface such as a wall is now met by a new, useful, and nonobvious invention.

The novel method includes the steps of providing a device having an elongate, straight configuration. A spirit level is mounted on the device so that the device can be positioned in abutting relation to a vertical support surface and rotated until it is level as indicated by the spirit level.

A pair of longitudinally spaced apart openings are formed in the device and each opening is adapted to accommodate a fastener means. Accordingly, the device is fastened to a vertical support surface by inserting a fastener means through each of the openings. A first, lowermost row of tile is installed on the vertical support surface, using the device to support said lowermost row of tiles from slipping downwardly under the force of gravity.

The fastener means are removed after the tile installation is complete so that the device can be reused.

In a preferred embodiment, the openings are elongated so that the fastener means may be inserted into the vertical support surface at any preselected location along the length of the respective openings. The openings are axially misaligned with respect to one another to maintain the structural integrity of the device.

In an additional embodiment, a first releasable coupler is formed in a first end of the device and a second releasable coupler is formed in a second end of the device. The first releasable coupler is adapted to releasably engage the second releasable coupler so that two of the devices may be releasably coupled to one another in end-to-end relation by releasably coupling the first releasable coupler at a first end of a first device to the second releasable coupler at a second end of a second device.

In a second embodiment, a plurality of notches are formed in the device along its extent so that the device can be bent to overlie convex and concave vertical support surfaces.

The novel device is made of a hard, durable, heat-resistant elastomeric rubberized material that does not stick to adhesives, cements, mastics, grout, or other materials used in tile installation.

The primary object of this invention is to provide an improved method for installing heavy tiles on a vertical support surface.

A closely related object is to provide such a method that does not require use of furring strips.

Another object is to provide a method using a device that is perfectly straight and re-usable.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which:

FIG. 7 is a side elevational view depicting a plurality of said devices when connected in end-to-end relation to one another;

FIG. 8 is a detailed and enlarged side elevational view of the circled area of FIG. 7 that is labeled with the reference numeral 8;

FIG. 9 is a top plan view of the device that facilitates the performance of the novel method, taken along line 9—9 in FIG. 7;

DETAILED DESCRIPTION

Figure 1:
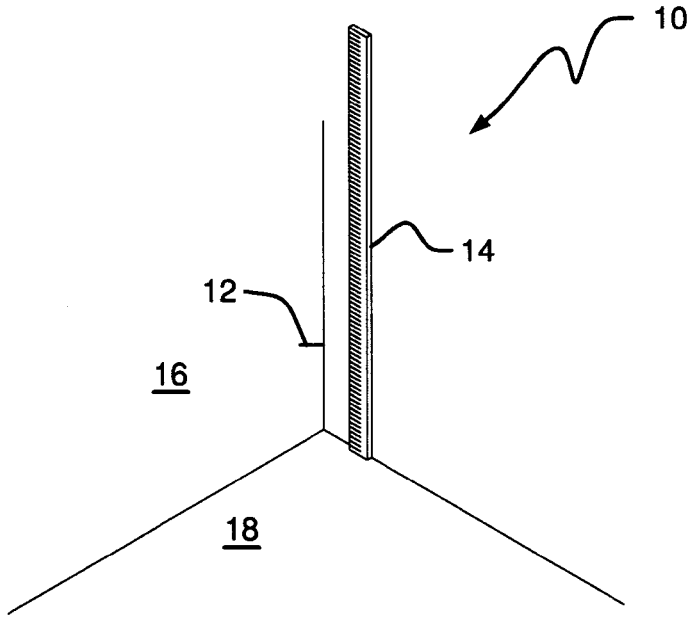
FIG. 1 depicts the first step in a prior art method for installing heavy tiles on a vertical support surface.
Figure 2:
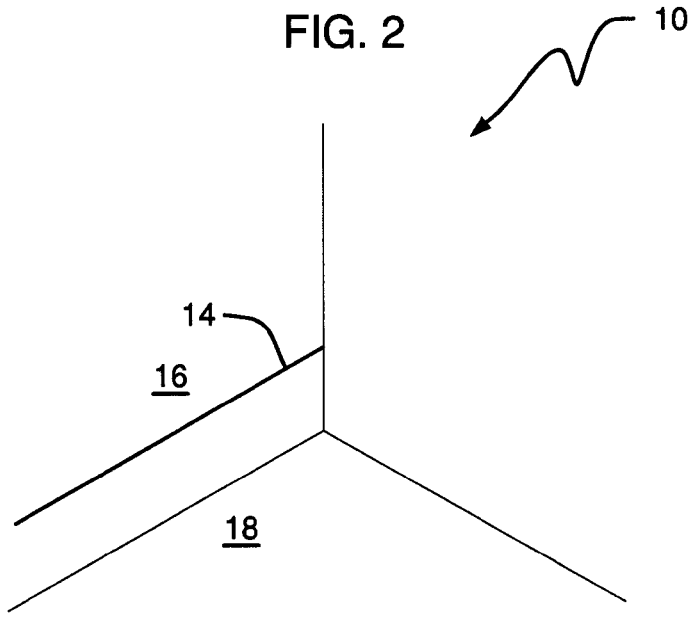
PRIOR ART FIG. 2
FIG. 2 depicts the second step in the prior art method.
Figure 3:
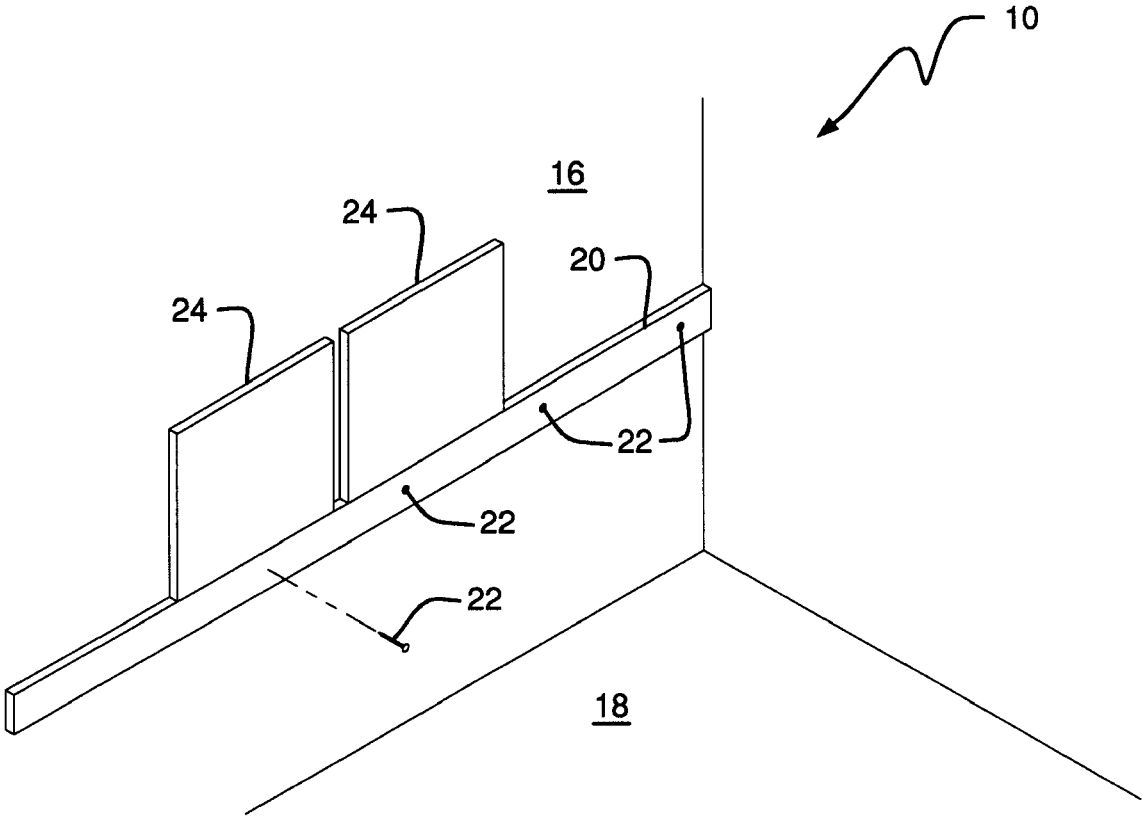
FIG. 3 depicts the third step in the prior art method.

Referring first to the prior art method depicted in animation form in FIGS. 1, 2, and 3, it will be understood in connection with FIG. 1 that the first step in installing heavy tiles on a vertical surface when following the conventional method is indicated as a whole by the reference numeral 10.

A measurement 12 using tape measure or ruler 14 is made on wall 16, taken from the surface of floor 18 adjoining wall 16.

The second step, as depicted in FIG. 2, is to draw a level pencil line using ruler 14. The line upon which ruler 14 is positioned is generated by a water level or a laser level. Ruler 14 is removed when the line has been drawn.

As indicated in FIG. 3, the third step is to nail furring strip 20 to wall 16, employing nails 22, so that the top edge of furring strip 20 is coincident with the straight line created in the second step. Shims are commonly used to adjust for warping in the furring strips but such shims are not illustrated because they are well-known and to simplify the drawing. Tiles 24 are thus supported against slippage by furring strip 20, it being understood that tiles 24 are in the bottom row of the tiles to be applied to wall 16.

The prior art step of FIG. 1 is also the first step when using the novel device. However, the prior art steps depicted in FIGS. 2 and 3 are not followed. Instead, after mark 12 is made on wall 16, novel device 40 is horizontally aligned on said wall 16 by placing device 40 in abutting relation to the wall and rotating it until center-mounted spirit level 52 ((FIG. 5) indicates that device 40 is level.

Figure 4:
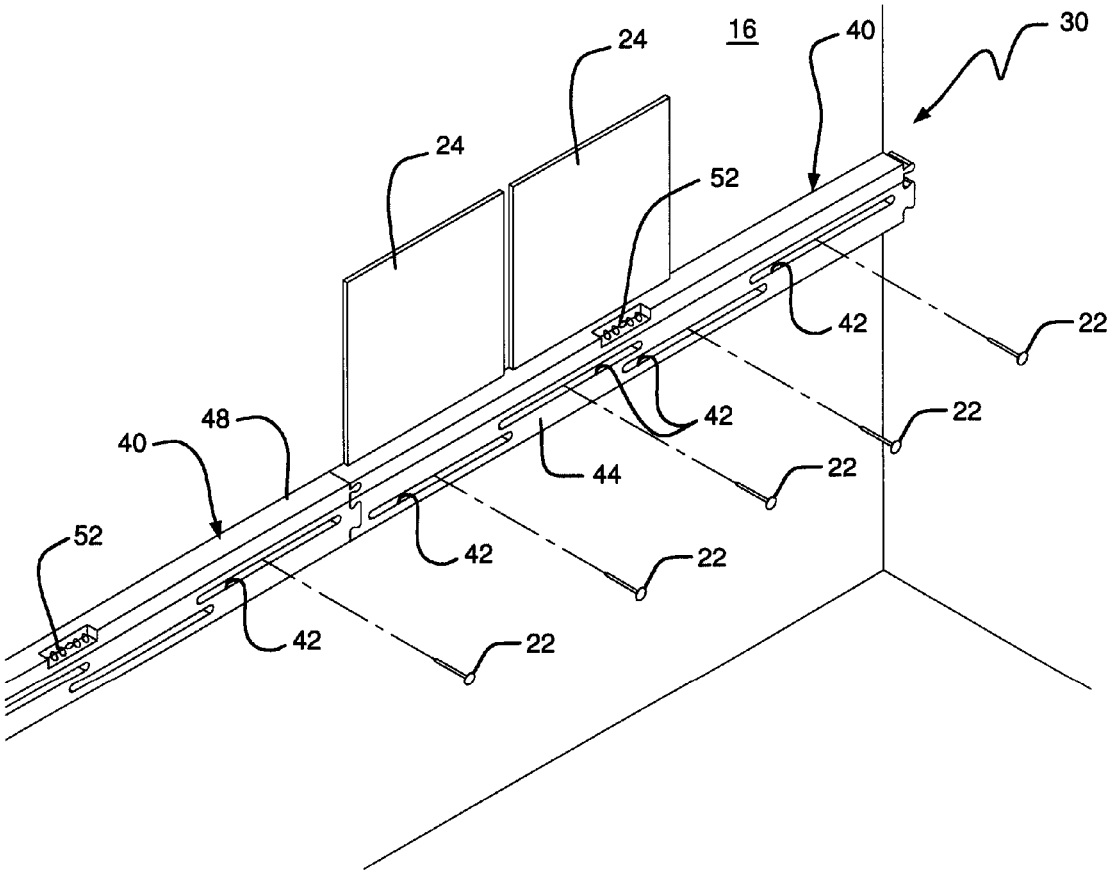
FIG. 4 is a perspective view depicting the novel method for installing heavy tiles on a vertical support surface when using a first embodiment of the novel device.

Novel tool 40 is then secured to wall 16 with nails 22 In FIG. 4, two (2) of novel tools 40 are depicted in end-to-end coupled relation to one another.

As best understood in connection with FIG. 4, no furring strip is needed. Tool 40 supports tiles 24 in a manner similar to a furring strip, but tool 40 is perfectly straight so the tiles supported thereby are aligned in a perfectly horizontal plane as well.

Figure 5:
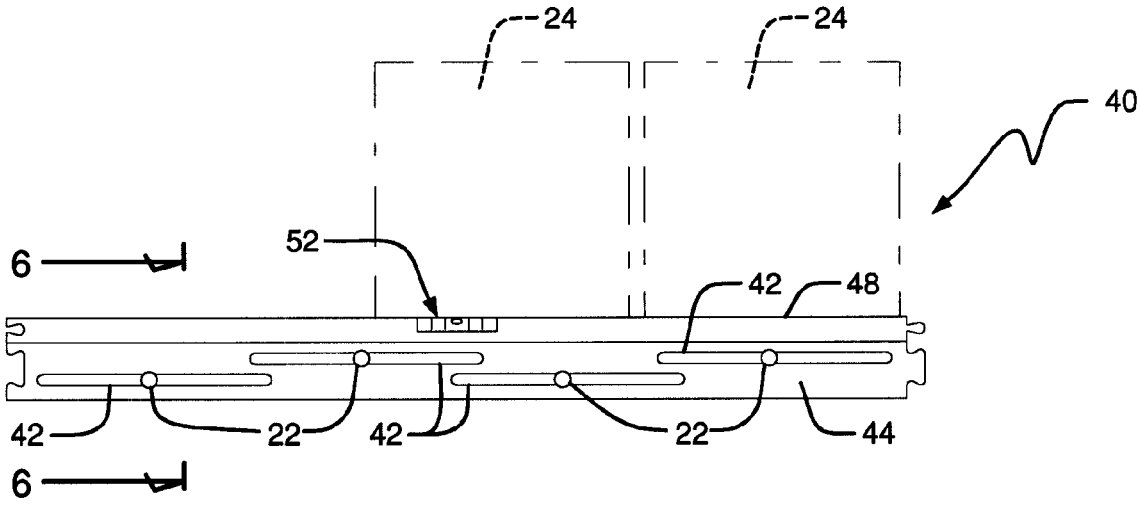
FIG. 5 is a front elevational view of substantially the same parts as in FIG. 4.

A plurality of elongate slots, collectively denoted 42, are formed in device 40 to accept fastening means 22 that may take the form of nails, tacks, screws, and the like. Slots 42 are depicted in FIG. 4 but are best depicted in FIG. 5. This enables the user to find the studs under wall 16 and to place the nails in those studs.

In the absence of such elongation, the chances of hitting a stud are slim and in such case a hollow wall anchor would need to be used, thereby slowing down the installation procedure. However, it should be understood that an embodiment having nothing more than a pair of nail or screw-receiving non-elongated openings is nonetheless within the scope of this invention.

Elongate slots 42 are vertically staggered, i.e., axially misaligned, as best depicted in FIG. 5 to enhance the structural integrity of device 40.

Tool 40 is preferably formed of a high impact plastic but the substitution of other suitable materials is within the scope of this invention. The materials from which tool 40 is made do not stick to the materials used during tile installation.

Figure 6:
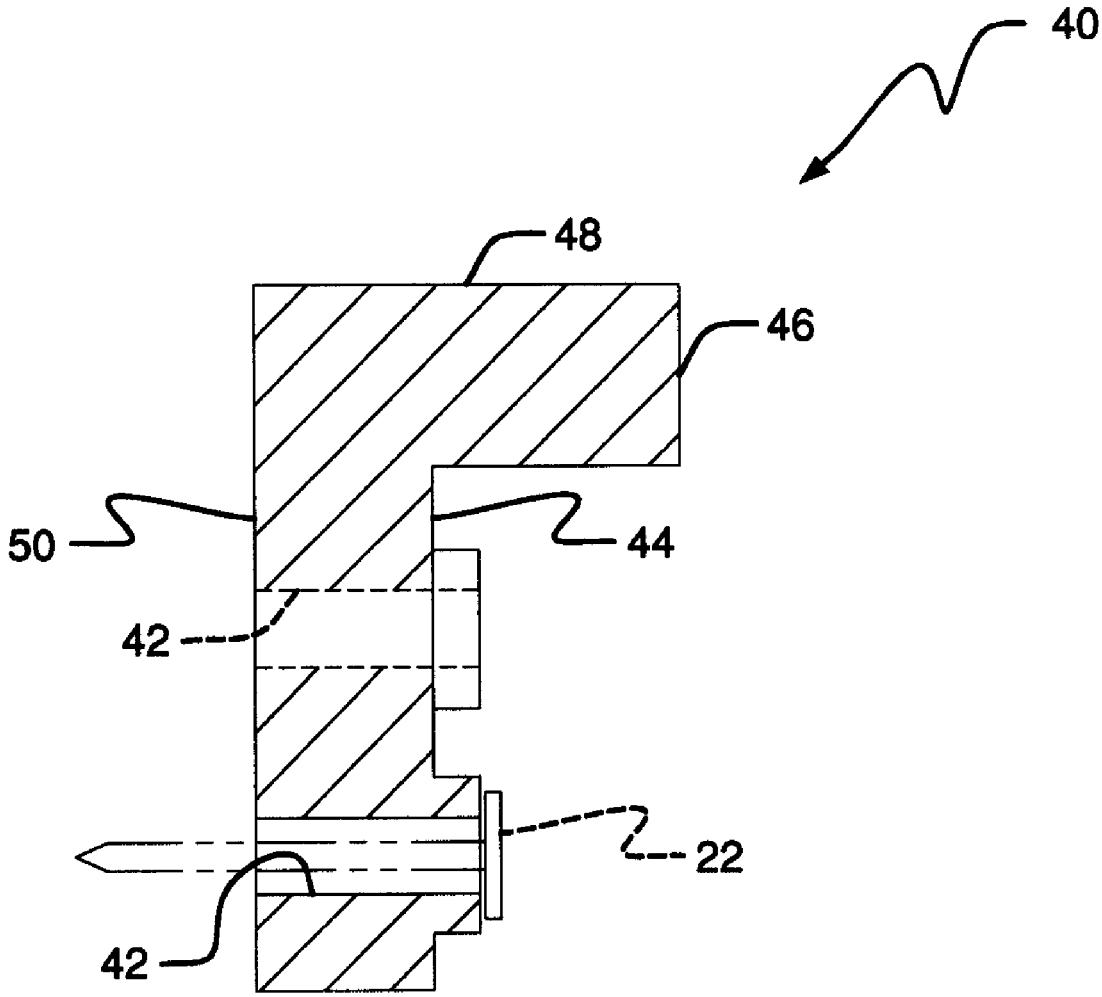
FIG. 6 is a sectional view taken along line 6—6 in FIG. 5.
Figure 10:
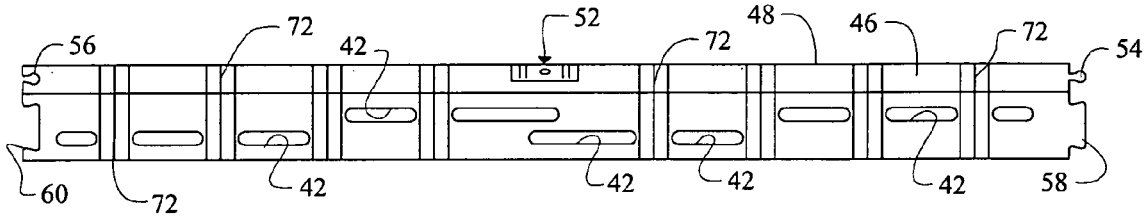
FIG. 10 is a side elevational view of a second embodiment of said device.

As best understood in connection with FIG. 6, device 40 includes base 44 and a tile support member 46 that projects outwardly relative to said base. Tile support member 46 has a flat tile-supporting surface 48 that performs the function its name expresses.

The depth of tile-supporting surface 48 must be greater than the combined depth of adhesive applied to vertical support surface 16 and the depth of a tile 24 positioned atop said adhesive.

Base 46 and tile support surface member 46 share a common flat back wall 50 that abuts vertical support surface 16 when device 40 is in use.

As best depicted in FIGS. 4, 5, 7, and 9, a preferred embodiment of the device includes center-mounted spirit level 52 mounted in a cavity formed in tile support member 46 in parallel alignment with tile support surface 48. Spirit level 52 is used in the well-known way to orient device 40 in a horizontal plane. Accordingly, when the bubble in said spirit level is centered in the well-known way, tile support surface 48 is perfectly horizontal.

Thus, to use device 40 when it is equipped with spirit level 52, device 40 is positioned against vertical support surface 16 so that flat back wall 50 lies flush thereagainst. Device 40 is positioned with tile support surface 48 in registration with a mark 12 on wall 16 as measured in prior art FIG. 1 and said device 40 is then rotated against vertical support surface 16 until spirit level 52 indicates that tile support surface 46 is perfectly horizontal. This eliminates the steps depicted in FIGS. 2 and 3. A first fastener means 22 is then driven through a preselected first elongate slot 42 into a first pre-located stud, not shown, and a second fastener means 22 is driven through a second elongate slot 42 into a second pre-located stud, not shown. Tile installation may then begin with the assurance that the lowermost row of tiles will be perfectly level.

When the installation procedure is completed, device 40, unlike the furring strips of the prior art, may be re-used.

Thus it is understood that an important requirement for the construction of device 40 is that tile support surface 48 must be perfectly straight and flat because tile support surface 48 is the surface relied upon to ensure that the lowermost row of tiles in an installation are perfectly level.

An equally important requirement is that spirit level 52 must be perfectly parallel to tile support surface 48 so that when the spirit level indicates that device 40 is perfectly level, said tile support surface 48 must also be perfectly level.

FIG. 7 depicts three devices 40, 40, 40 when releasably connected to one another in end-to-end relation. It should be understood that any number of devices 40 may be connected to one another in the same way.

More particularly, as best depicted in FIG. 8, a ball and socket joint is made by forming ball 54 in a first end of tile support member 46 of a first device 40 and a socket 56 that mates therewith in a second end of tile support member 46 of a second device 40.

Similarly, a dove tail protuberance 58 is formed in said first end of said tile support member 46 of said first device 40 and a mating dove tail opening 60 is formed in said second end of said tile support member 46 of said second device 40.

Both of these locking means are releasable. To separate one device 40 from another, a user holds the devices in different hands and pulls one of the devices while pushing the other along a path of travel that is ninety degrees (90°) relative to a longitudinal axis of the devices.

Figure 11:
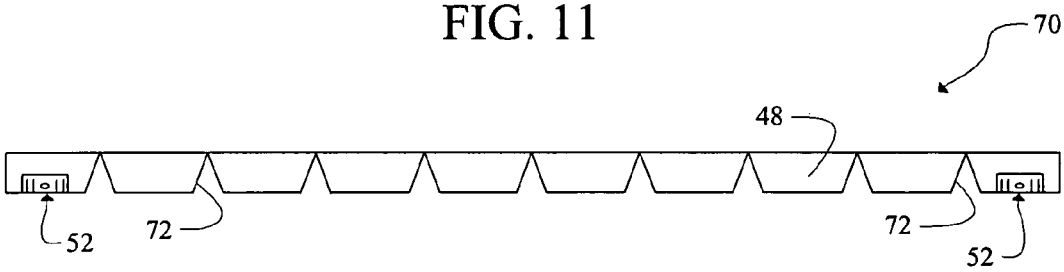
FIG. 11 is a top plan view of the device depicted in FIG. 10.
Figure 12:
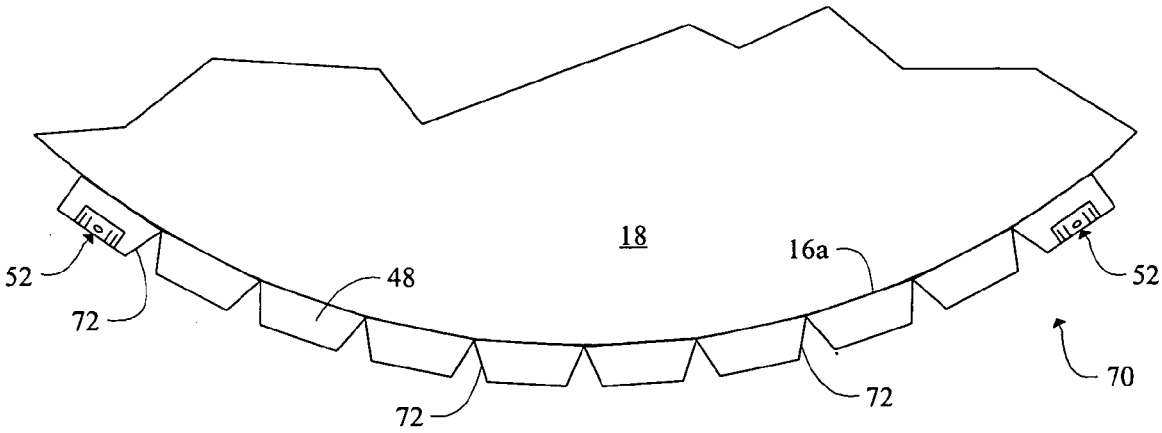
FIG. 12 is a top plan view depicting the second embodiment of the device when used on a convex wall surface.
Figure 13:
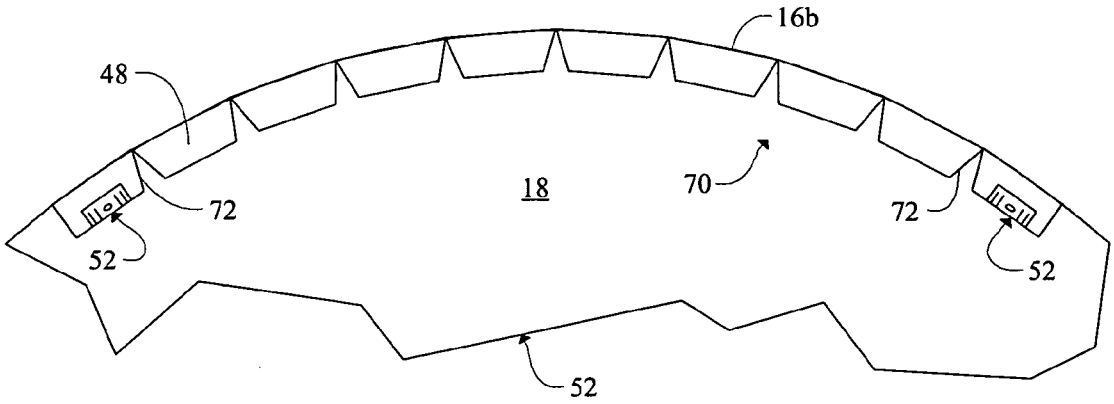
FIG. 13 is a top plan view depicting the second embodiment of the device when used on a concave wall surface.

A second embodiment of the novel device is depicted in FIGS. 11–13 and is denoted by the reference numeral 70 as a whole.

The structure of device 70 is substantially the same as device 40 as indicated by the common reference numerals applied thereto, with the additional feature of a plurality of "V"-shaped notches, collectively denoted 72, being formed therein along the longitudinal extent thereof.

Moreover, instead of one center-mounted spirit level 52, there is a spirit level 52 mounted at each end of the device.

The provision of notches 72 mandates that elongate slots 42 be truncated as shown but said slots still offer at least some elongation that facilitates attachment of device 70 to studs.

Each notch 72 extends almost all the way to back wall 50.

Notches 72 enable use of device 70 on a convex wall 16*a* as depicted in FIG. 12 or on a concave wall 16*b* as depicted in FIG. 13. In all other respects, device 70 and spirit levels 52, 52 are used in the same way as the first embodiment.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A method for installing tiles on a vertical support surface, comprising the steps of:

providing a device having an elongate, single solid straight configuration body;

said device having a spirit level having a bubble;

forming in said device a plurality of longitudinally spaced apart openings;

axially misaligning the openings with respect to one another to maintain structural integrity of the device so that said device may be affixed to a stud behind said vertical support surface without limitation relating to the location of the stud;

adapting each of said openings to accommodate a fastener means;

providing a tile support surface along an upper edge of said device;

making mark on said vertical support surface at a predetermined location thereon;

positioning said tile support surface of said device in abutting, overlying relation to said vertical support surface in registration with said mark and rotating said device against said vertical support surface until said spirit level indicates that said tile support surface is horizontal;

fastening said device to said vertical support surface by inserting a fastener means through at least two of said openings;

installing a lowermost row of tiles on said vertical support surface such that said lowermost row of tiles is supported by said tile support surface;

removing said fastener means after said tile installation is complete; and removing said device from said overlying relation to said vertical support surface;

whereby said lowermost row of tiles in said tile installation is level; and installing subsequent rows of tiles using said lowermost row of tiles as a foundation such that the subsequent rows are also level.

2. The method of claim 1, further comprising the steps of:

forming a first releasable coupler in a first end of said device;

forming a second releasable coupler in a second end of said device;

adapting said first releasable coupler to releasably engage said second releasable coupler so that two of said devices may be releasably coupled to one another in end-to-end relation by releasably coupling said first releasable coupler at a first end of a first device to the second releasable coupler at a second end of a second device.

3. The method of claim 1, further comprising the steps of:

dimensioning a base of said device to have a first predetermined depth;

dimensioning said tile support surface to have a second predetermined depth greater than said first predetermined depth;

forming said base and tile support surface so that they share a common flat back wall adapted to abuttingly engage said vertical support surface;

sizing said second predetermined depth so that it is approximately equal to a combined thickness of a tile and of a layer of adhesive underlying said tile.

4. The method of claim 1, further comprising the steps of:

forming a plurality of notches in said device along the extent thereof;

forming each notch of said plurality of notches so that it has a depth only slightly less than a depth of said device;

bending said device at said notches so that said device overlies a convex wall.

5. The method of claim 1, further comprising the steps of:

forming a plurality of notches in said device along the extent thereof;

forming each notch of said plurality of notches so that it has a depth only slightly less than a depth of said device;

bending said device at said notches so that said device overlies a concave wall.

* * * * *